US009122221B2

(12) United States Patent
Mizuguchi

(10) Patent No.: US 9,122,221 B2
(45) Date of Patent: Sep. 1, 2015

(54) SHEET FEEDING CASSETTE, SHEET FEEDING DEVICE, AND IMAGE FORMING APPARATUS

(71) Applicant: KYOCERA Document Solutions Inc., Osaka-shi, Osaka (JP)

(72) Inventor: Keisuke Mizuguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/169,075

(22) Filed: Jan. 30, 2014

(65) Prior Publication Data

US 2014/0212194 A1 Jul. 31, 2014

(30) Foreign Application Priority Data

Jan. 31, 2013 (JP) ..... 2013-016347

(51) Int. Cl.
*G03G 15/00* (2006.01)
*B65H 1/00* (2006.01)

(52) U.S. Cl.
CPC ..... *G03G 15/6505* (2013.01)

(58) Field of Classification Search
CPC ... G03G 15/00; G03G 21/00; G03G 15/6505; B65H 1/00; B65H 1/04; B65H 1/08; B65H 1/14
USPC ..... 399/388, 393; 271/145–148, 157, 158, 271/160, 162
See application file for complete search history.

(56) References Cited

U.S. PATENT DOCUMENTS

2010/0294638 A1 11/2010 Maruyama et al.

FOREIGN PATENT DOCUMENTS

| | | | | | |
|---|---|---|---|---|---|
| JP | 59039633 | A | * | 3/1984 | G03G 15/00 |
| JP | 07179230 | A | * | 7/1995 | B65H 1/14 |
| JP | 10067441 | A | * | 3/1998 | G03G 15/00 |
| JP | 11222329 | A | * | 8/1999 | B65J 29/00 |
| JP | 2003089438 | A | | 3/2003 | |
| JP | 2005247436 | A | * | 9/2005 | G65H 3/46 |
| JP | 2005320133 | A | | 11/2005 | |
| JP | 2006137500 | A | * | 6/2006 | B65H 3/46 |
| JP | 2007217185 | A | * | 8/2007 | B65H 1/26 |
| JP | 2008120496 | A | * | 5/2008 | B65H 1/26 |
| JP | 2010030692 | A | | 2/2010 | |
| JP | 2010272321 | A | | 12/2010 | |
| JP | 2012246076 | A | * | 12/2012 | G03G 15/00 |

* cited by examiner

*Primary Examiner* — Nguyen Ha
(74) *Attorney, Agent, or Firm* — Alleman Hall McCoy Russell & Tuttle LLP

(57) ABSTRACT

A sheet feeding cassette according to one aspect of the present disclosure is a sheet feeding cassette that displaces a bottom plate loaded thereon with a sheet to a sheet feeding position by rotating a lift plate that abuts on a rear face of the bottom plate. The bottom plate is made of resin, and a wire is wired on the rear face of the bottom plate.

11 Claims, 8 Drawing Sheets

SHEET FEEDING CASSETTE, SHEET FEEDING DEVICE, AND IMAGE FORMING APPARATUS

INCORPORATION BY REFERENCE

This application is based upon and claims the benefit of priority from the corresponding Japanese Patent Application No. 2013-016347 filed on Jan. 31, 2013, the entire contents of which are incorporated herein by reference.

BACKGROUND

The present disclosure relates to a sheet feeding cassette that displaces a bottom plate loaded thereon with a sheet to a sheet feeding position by a lift-up method, a sheet feeding device thereof, and an image forming apparatus including the sheet feeding device.

In an image forming apparatus such as a copier or a printer that forms an image on a sheet by electrophotography, a sheet feeding cassette that stores a sheet is provided to be attached and detached to and from an inside of the device body. Some sheet feeding cassettes employ a lift-up method of displacing a bottom plate loaded thereon with a sheet to a sheet feeding position by rotating a lift plate that abuts on a rear face of the bottom plate. In such a sheet feeding cassette, sheets loaded on the bottom plate are picked up from an uppermost sheet, and fed to an image forming portion at a predetermined timing.

Meanwhile, since a number of sheets are loaded on the bottom plate of the sheet feeding cassette, high strength and rigidity are required for the bottom plate. Therefore, the bottom plate is generally made of metal.

Further, static electricity is generated by rubbing of sheets in feeding out a sheet from the sheet feeding cassette, and when the static electricity is accumulated in the sheet in the sheet feeding cassette, a problem of multi-feed of sheets occurs. Therefore, a grounding configuration that releases the static electricity generated by rubbing of sheets is employed.

Meanwhile, there is a problem of increase in cost when the bottom plate of the sheet feeding cassette is made of metal as in a conventional manner. Therefore, it is conceivable that the bottom plate is made of low-cost resin, however, there is a problem that the bottom plate made of resin is easily deformed.

Further, the low-strength bottom plate made of resin has a problem that a portion on which the lift plate on the rear face of the bottom plate abuttingly slides is easily worn away, and in addition, there is also a problem that non-conductive resin does not conduct static electricity, and thus grounding is difficult.

Then, it is conceivable that the bottom plate made of resin is reinforced by a reinforcing plate, however, there is a problem that such reinforcement entails increase in cost.

The present disclosure has been made in view of the above-described problems, and an object of the present disclosure is to provide a sheet feeding cassette including a bottom plate with high strength and rigidity even with low cost and a simple configuration, a sheet feeding device, and an image forming apparatus including the sheet feeding device.

SUMMARY

A sheet feeding cassette according to one aspect of the present disclosure is a sheet feeding cassette that displaces a bottom plate loaded thereon with a sheet to a sheet feeding position by rotating a lift plate that abuts on a rear face of the bottom plate. The bottom plate is made of resin, and a wire is wired on the rear face of the bottom plate.

A sheet feeding device according to another aspect of the present disclosure includes a sheet feeding cassette that displaces a bottom plate loaded thereon with a sheet to a sheet feeding position by rotating a lift plate that abuts on a rear face of the bottom plate. The bottom plate is made of resin, and a wire is wired on the rear face of the bottom plate.

An image forming apparatus according to another aspect of the present disclosure includes a sheet feeding device and an image forming portion. The sheet feeding device includes a sheet feeding cassette that displaces a bottom plate loaded thereon with a sheet to a sheet feeding position by rotating a lift plate that abuts on a rear face of the bottom plate. The image forming portion forms an image on a sheet fed from the sheet feeding device. The bottom plate is made of resin, and a wire is wired on the rear face of the bottom plate.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any portion of this disclosure.

DETAILED DESCRIPTION

An embodiment of the present disclosure will be described below on the basis of the attached drawings.

[Image Forming Apparatus]

Figure 1:
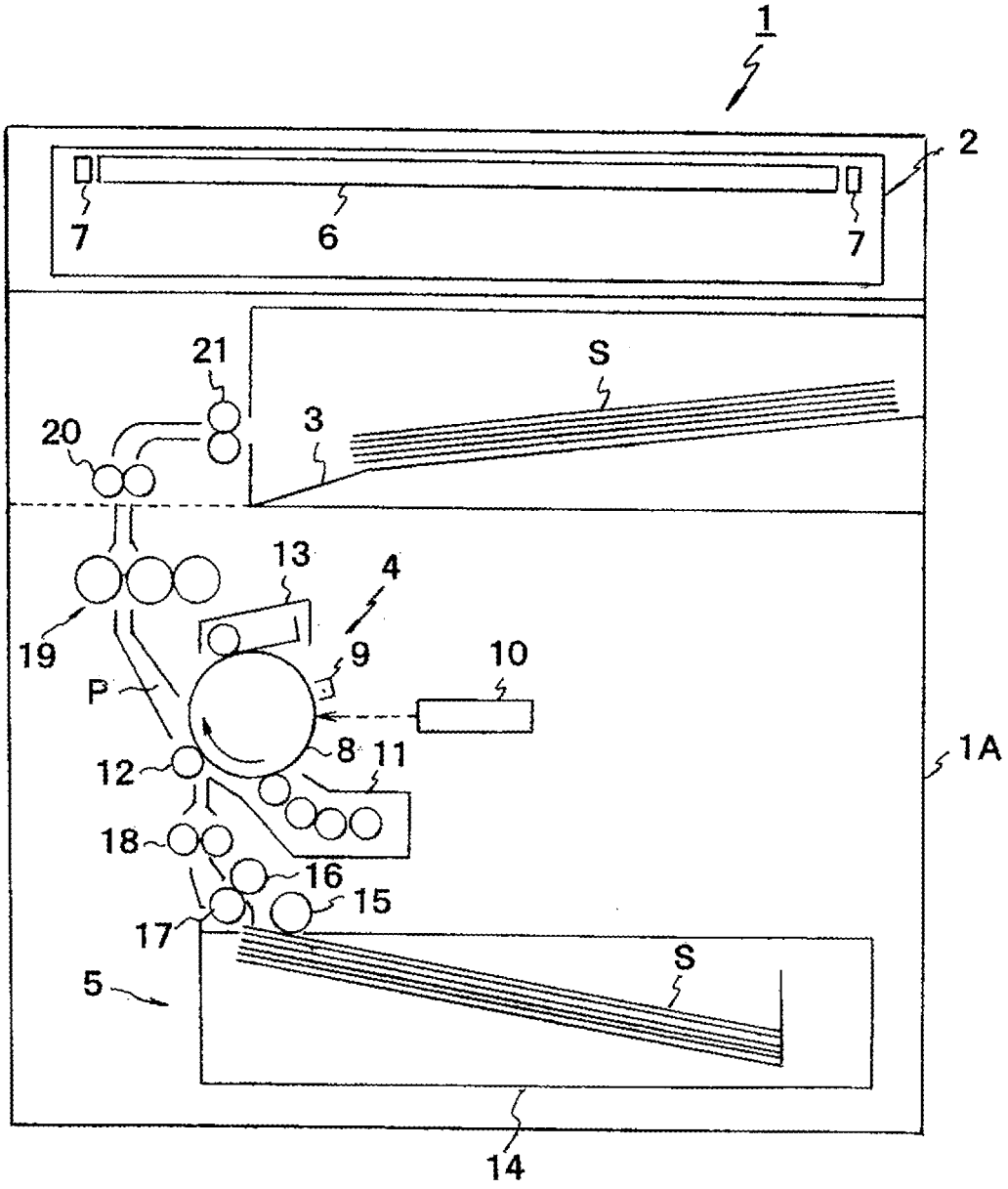
FIG. 1 is a sectional side view of an image forming apparatus according to the present disclosure.

An image forming apparatus 1 shown in FIG. 1 is a monochromatic copier, on an upper part of a device body 1A of the image forming apparatus 1, an image reading device 2 is included, and a sheet discharge tray 3 is provided therebelow. Moreover, an image forming portion 4 is arranged inside the device body 1A, and a sheet feeding portion 5 is arranged therebelow.

The above-described image reading device 2 includes two light guides 6 arranged in a main scanning direction (in a right-left direction of FIG. 1) and an LED 7 as a light source arranged on each position facing an incident face of an outer end face, in the main scanning direction, of each of the light guides 6. The image reading device 2 employs a side-light method in which light from each of both LEDs 7 is caused to enter from the incident face of each light guide 6 to be guided to the main scanning direction. It is noted that, in the image reading device 2, the light guide 6 and the LED 7 are supported to be capable of reciprocating in a sub scanning direction (in a vertical direction of a sheet face of FIG. 1). Further, although it is not shown, the image reading device 2 includes an imaging lens that produces an image of reflected light reflected on a document, and a photoelectric conversion element such as a CCD that converts an optical image produced by the imaging lens into an electric signal so that the optical image is read.

The image forming portion 4 is to form an image by electrophotography. The image forming portion 4 includes a photosensitive drum 8 as an image carrier arranged to be rotatable, a charger 9 arranged around the photosensitive drum 8, a laser scanner unit (LSU) 10, a developing device 11, a transfer roller 12, and a cleaning device 13.

Further, the sheet feeding portion 5 includes a sheet feeding cassette 14 that can be attached to and detached from the device body 1A, and also includes a pickup roller 15, a feed roller 16, and a retard roller 17 which are arranged in the vicinity of the sheet feeding cassette 14. Here, a plurality of sheets S are stacked and stored in the sheet feeding cassette 14, the sheets S in the sheet feeding cassette 14 are taken out one by one in order from an uppermost sheet by the pickup roller 15, and fed out to a sheet conveying path P while a multi-feed is prevented by the feed roller 16 and the retard roller 17. The above-described sheet conveying path P extends upward from the sheet feeding portion 5 to the sheet discharge tray 3, and on the sheet conveying path P, a resist roller 18, the transfer roller 12, a fixing device 19, a conveying roller 20, a sheet discharge roller 21 are arranged in order from underneath.

Next, an image forming operation of the image forming apparatus 1 configured as above will be described.

When the image forming operation is started, in the image forming portion 4, the photosensitive drum 8 is rotationally driven by a not-shown driving means in an arrow (clockwise) direction of FIG. 1, and a surface thereof is uniformly charged to predetermined potential by the charger 9. Then, in the image forming portion 4, a document image is read by the image reading device 2, a laser beam based on an electric signal transmitted from the image reading device 2 is output from the laser scanner unit (LSU) 10, and a surface of the photosensitive drum 8 is subjected to exposure scanning. Thereby, an electrostatic latent image corresponding to image information is formed on the photosensitive drum 8. Then, the electrostatic latent image formed on the photosensitive drum 8 is developed by using toner as developer by the developing device 11 to be visualized as a toner image.

On the other hand, the sheets S stored in the sheet feeding cassette 14 of the sheet feeding portion 5 are taken out one by one in order from the uppermost sheet by the pickup roller 15 and fed out to the sheet conveying path P while a multi-feed is prevented by the feed roller 16 and the retard roller 17 as described above. Then, the sheet S fed out to the sheet conveying path P in this way is conveyed to the resist roller 18 along the sheet conveying path P, put in a temporary stand-by state in the resist roller 18, and thereafter supplied to the image forming portion 4 at a predetermined timing to synchronize with the toner image on the photosensitive drum 8.

The sheet S supplied to a transfer nip between the photosensitive drum 8 and the transfer roller 12 is conveyed while being pressed against the photosensitive drum 8 by the transfer roller 12, and thereby the toner image on the photosensitive drum 8 is transferred onto the surface of the sheet. Then, the sheet S onto which the toner image is transferred is conveyed to the fixing device 19 to be heated and pressurized in a process of passing through a fixing nip of the fixing device 19. Thereby, the toner image is fixed on the sheet S. It is noted that toner remaining on a surface of the photosensitive drum 8 after the transfer of the toner image onto the sheet S (remaining toner after transfer) is removed by the cleaning device 13, and the photosensitive drum 8 having the surface cleaned is prepared for a next image forming operation.

Then, the sheet S having the surface on which the toner image is fixed by the fixing device 19, is conveyed to the sheet discharge roller 21 along the sheet conveying path P by the conveying roller 20 to be discharged into the sheet discharge tray 3 by the sheet discharge roller 21, and thereby a series of image forming operations are ended.

[Sheet Feeding Cassette]

Next, the sheet feeding cassette 14 according to the present disclosure will be described below on the basis of FIG. 2 to FIG. 8.

Figure 2:
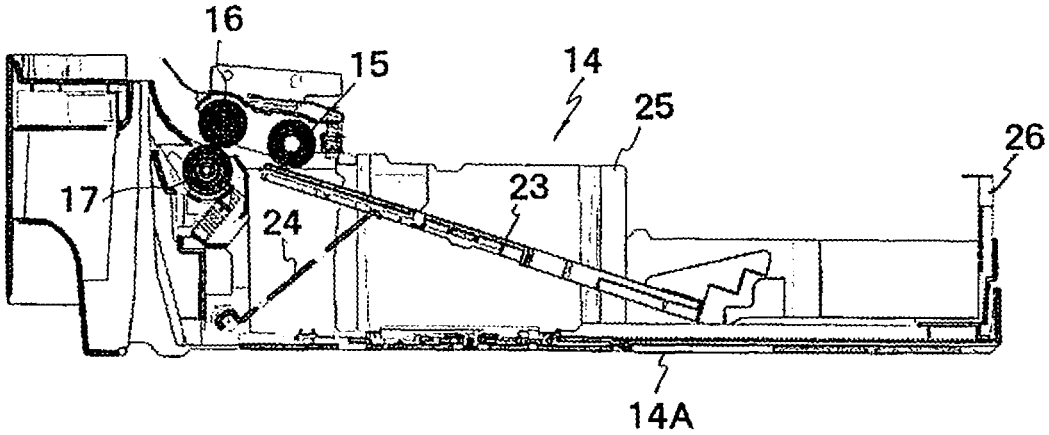
FIG. 2 is a sectional side view of a sheet feeding cassette part in an image forming apparatus according to the present disclosure.
Figure 3:
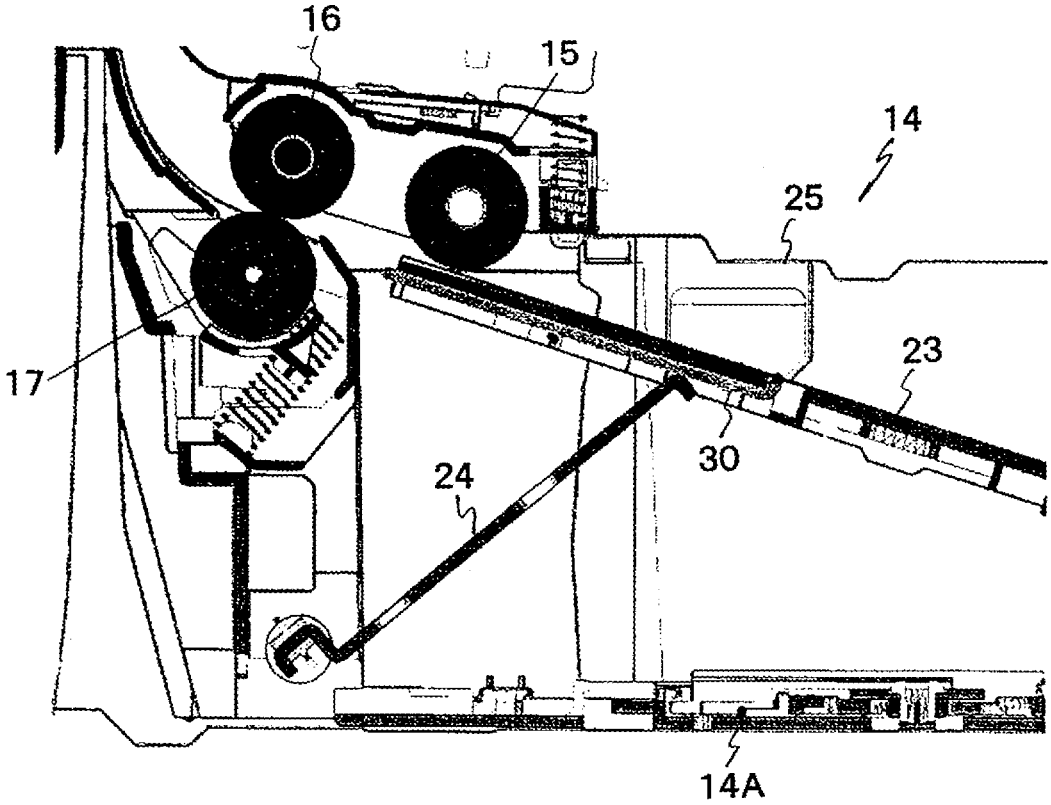
FIG. 3 is an enlarged sectional view of a main part of a sheet feeding cassette part in an image forming apparatus according to the present disclosure.
Figure 4:
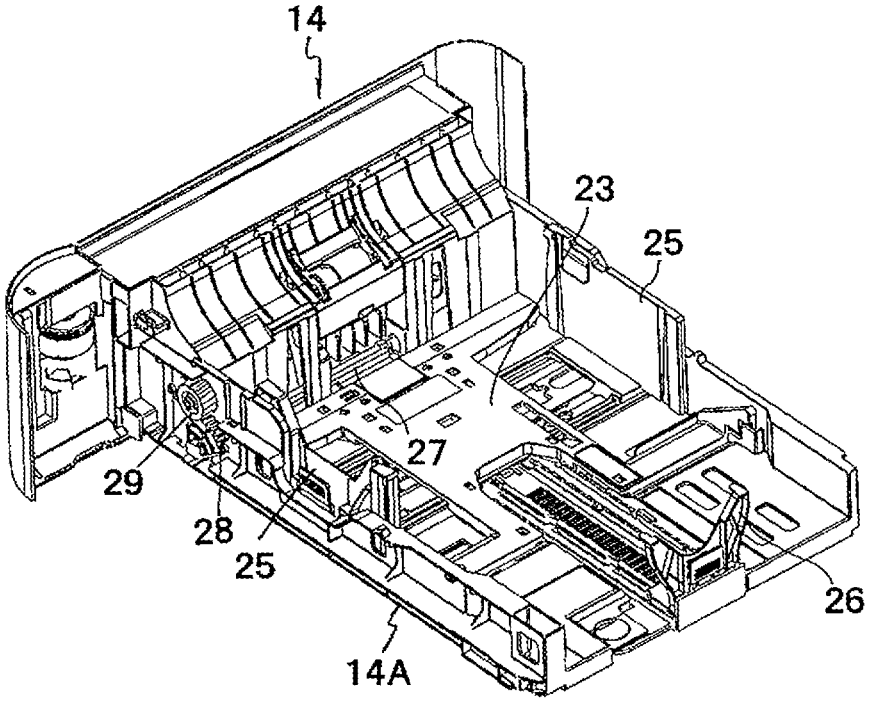
FIG. 4 is a perspective view of a sheet feeding cassette according to the present disclosure.

As shown in FIG. 2, the sheet feeding cassette 14 includes a cassette body 14A in a flat rectangular-box shape with a top face that is opened. In the cassette body 14A, a bottom plate 23, a lift plate 24, a pair of side cursors 25, and an end cursor 26 are provided. The bottom plate 23 rotates upward and downward with shafts 22 (see FIG. 6 and FIG. 7), as fulcrums, protrusively provided on the right and left of a depth-side end portion (a right-side end portion of FIG. 2) of the cassette body 14A. As shown in FIG. 2 to FIG. 4, one end of the lift plate 24 abuts on the rear face of the bottom plate 23. The pair of side cursors 25 are to abut on both side portions of the sheets S loaded on the bottom plate 23 so as to align the width of the sheets S, and slidably provided in the cassette body 14A. The end cursor 26 is to be abut on a rear end of the sheets S so as to align a front and a rear of the sheets S, and slidably provided in the cassette body 14A.

Figure 5:
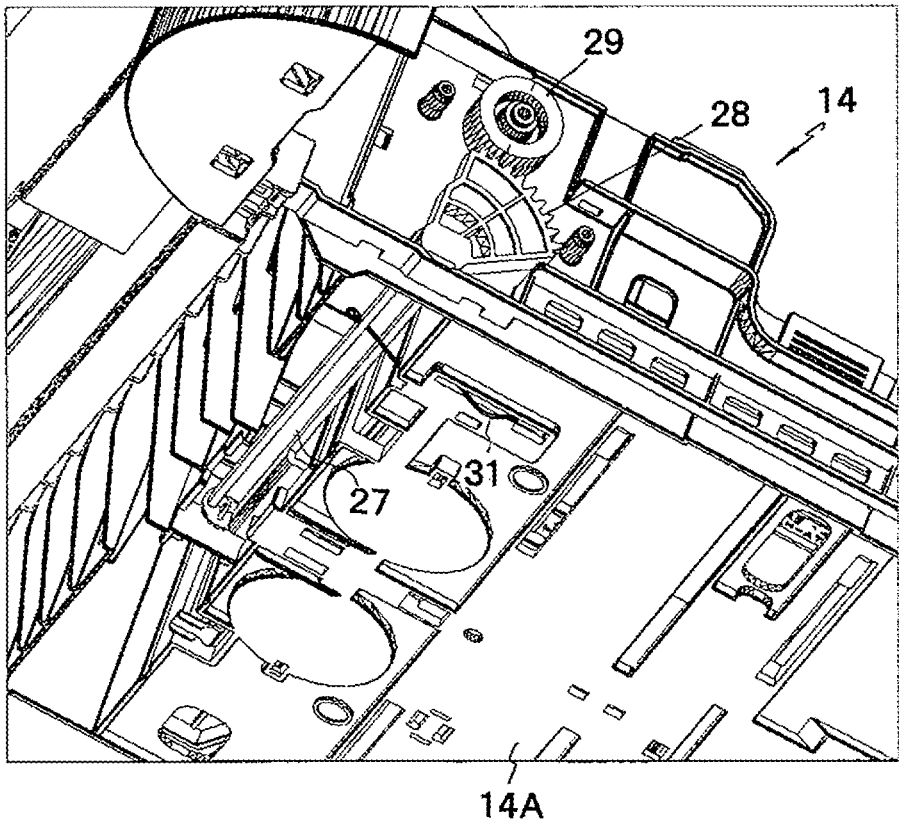
FIG. 5 is a perspective view of a main part of a sheet feeding cassette according to the present disclosure as seen obliquely from below.

Meanwhile, the sheet feeding cassette 14 according to the present embodiment employs a lift-up method of displacing the bottom plate 23 by rotating the lift plate 24 made of metal to a sheet supplying position as shown in FIG. 2 and FIG. 3. A base end portion of the lift plate 24 is supported, by the cassette body 14A, to be capable of rotating upward and downward with the rotating shaft 27 made of metal shown in FIG. 5. A tip end portion, bent in an L shape as seen from a side, of the lift plate 24 abuts on the rear face of the bottom plate 23 as described above (specifically, a wire described below). Here, as shown in FIG. 4 and FIG. 5, the rotating shaft 27 is arranged in a right-left direction of the cassette body 14A (a direction orthogonal to the sheet feeding direction) and a sector gear 28 in a sectorial shape is attached to an one end protruding from one side wall of the cassette body 14A. Further, a gear 29 with a small diameter rotatably supported by the one side wall of the cassette body 14A, is engaged with the sector gear 28 on an upper part thereof.

Further, in a state where the sheet feeding cassette 14 is installed inside the device body 1A as shown in FIG. 2 and FIG. 3, when the gear 29 rotates by receiving rotational driving force from a driving portion (not shown) provided on a side of the device body 1A, the sector gear 28 engaged therewith rotates. Then, the rotating shaft 27 attached with the sector gear 28 rotates, the lift plate 24 attached to the rotating shaft 27 rotates in a counterclockwise direction of FIG. 2 and FIG. 3 around the rotating shaft 27. Therefore, the bottom plate 23 having the rear face abutting on the tip end of the lift plate 24 rotates around the shafts 22 (see FIG. 6 and FIG. 7)

in a clockwise direction of FIG. 2 and FIG. 3, and the bottom plate 23 and the sheet S loaded thereon are lifted up to the sheet supplying position shown in FIG. 2 and FIG. 3.

Figure 6:
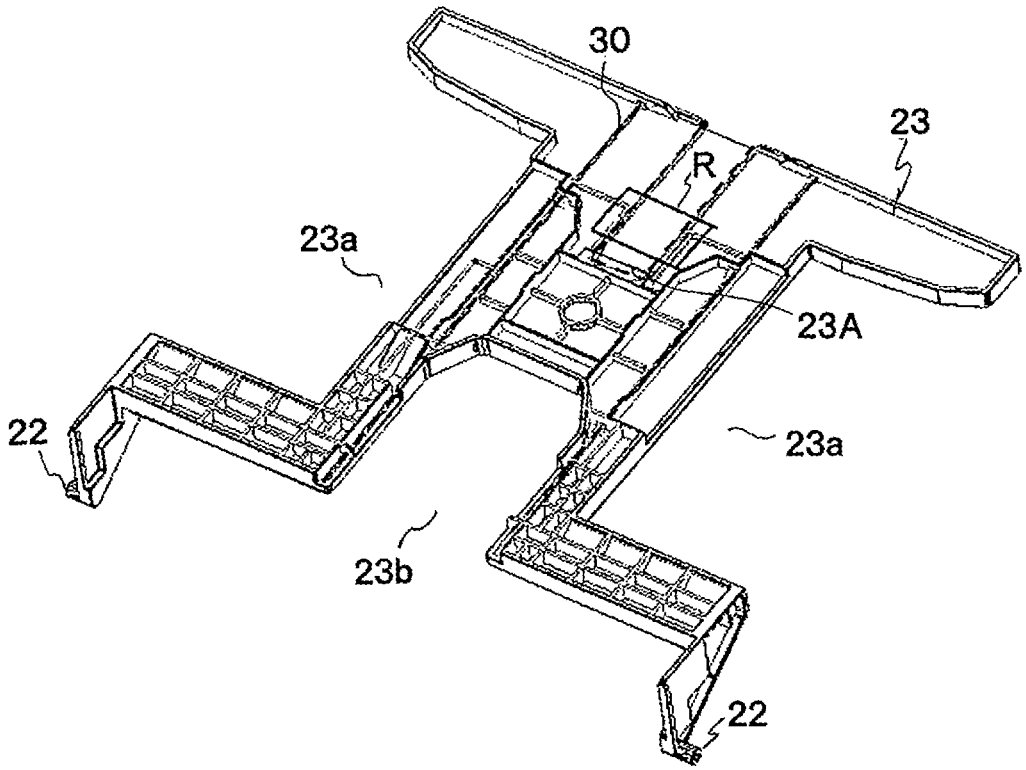
FIG. 6 is a perspective view of a bottom plate of a sheet feeding cassette according to the present disclosure as seen from a rear face side of the bottom plate.
Figure 7:
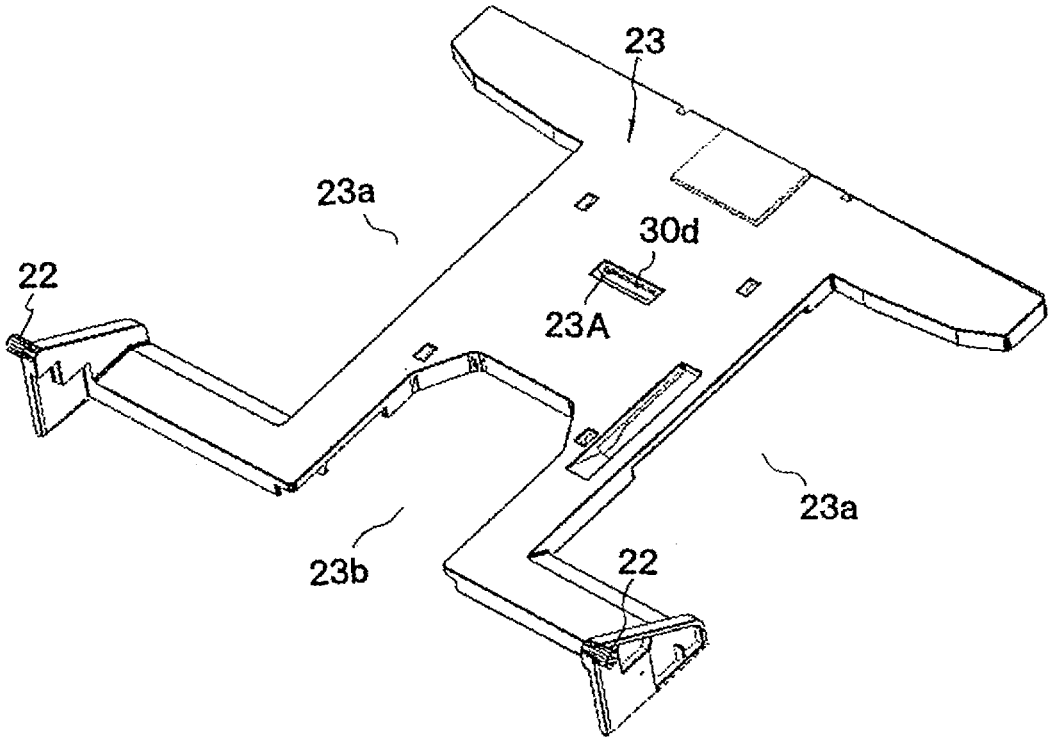
FIG. 7 is a perspective view of a bottom plate of a sheet feeding cassette according to the present disclosure as seen from a top face side of the bottom plate.

Meanwhile, as shown in FIG. 6 and FIG. 7, a notch 23*a* for allowing the side cursors 25 to slide is formed on the right and left of the bottom plate 23. Further, a notch 23*b* for allowing the end cursor 26 to slide is formed in a central portion in a width direction on a depth side of the bottom plate 23. Thereby, the bottom plate 23 is shaped in a substantially H shape.

Figure 8:
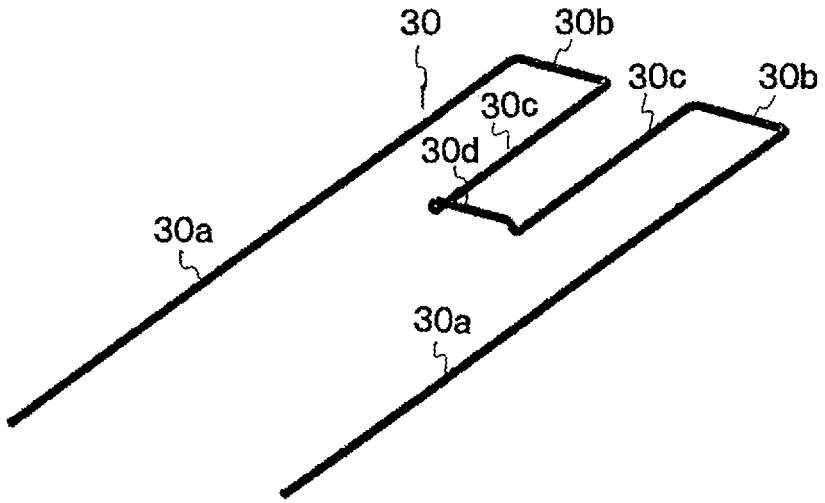
FIG. 8 is a perspective view of a wire that reinforces a bottom plate of a sheet feeding cassette according to the present disclosure.

Further, in the present embodiment, the bottom plate 23 is integrally shaped with resin, and reinforced by a wire 30 integrated into the rear face of the bottom plate 23 as shown in FIG. 6. This makes it possible to constitute the bottom plate 23 to be at low cost and with a simple configuration while securing strength and rigidity required for the bottom plate 23 and preventing the bottom plate 23 from being deformed. Here, the wire 30 is bent as shown in FIG. 8, and configured by bending, inward at right angles, respective end portions of two parallel portions 30*a* on the right and left, thereafter, further bending inward end portions of bent portions 30*b* of the parallel portions 30*a* at right angles to form two parallel portions 30*c* which are short and narrow in width, and slightly raising a connection portion 30*d* (a protruding portion) that connects the parallel portions 30*c* on the right and left.

The above-described wire 30 is integrated into the rear face of the bottom plate 23, and thereby the bottom plate 23 is reinforced by the wire 30. A tip end (one end) of the lift plate 24 that lifts up the bottom plate 23 slides in a sliding range R shown in FIG. 6. In this case, the parallel portions 30*c* of the wire 30 are exposed to the rear face of the bottom plate 23, and configured such that the tip end of the lift plate 24 abuttingly slides on a part that is surrounded by the sliding range R and provided in the parallel portions 30*c*. That is, the tip end of the lift plate 24 does not directly contact with the bottom plate 23, and abuts on the parallel portions 30*c* of the wire 30 positioned in the sliding range R so as to slide over the sliding range R. Accordingly, when the bottom plate 23 is lifted up, the tip end of the lift plate 24 abuttingly slides on the parallel portions 30*c* within the sliding range R. Therefore, there is no chance for the lift plate 24 to be directly in contact with the bottom plate 23 made of resin, a portion of the bottom plate 23 at which the lift plate 24 slides is prevented from being worn away, and durability of the bottom plate 23 is enhanced.

Further, as shown in FIG. 6 and FIG. 7, a rectangular opening portion 23A is formed in a central portion in a width direction of the bottom plate 23. The connection portion 30*d* of the wire 30 protrudes from the opening portion 23A to a top face (a sheet loading face) of the bottom plate 23. Specifically, the connection portion 30*d* at which the wire 30 is raised is penetrated through the opening portion 23A from a rear face side, and the connection portion 30*d* slightly protrudes to the top face (the sheet loading face) of the bottom plate 23. Then, as shown in FIG. 5, one end of the wire 31 integrated into a bottom portion of the cassette body 14A contacts with the rotating shaft 27 of the lift plate 24, and both the rotating shaft 27 and the one end of the wire 31 are electrically conducted. The other end of the wire 31 is bent in a U shape, slightly protrudes downward from a lower face of the cassette body 14A and contacts with a not-shown body frame made of sheet metal of the device body 1A. Accordingly, a lowermost sheet S out of the sheets S stored in the sheet feeding cassette 14 contacts with the connection portion 30*d* of the wire 30 by way of elasticity of the wire. This constitutes a grounding configuration capable of releasing static electricity accumulated in the sheet S loaded on the bottom plate 23 from the wire 30, through the lift plate 24, the rotating shaft 27 of the lift plate 24, and the wire 31, to the body frame made of sheet metal of the device body 1A. It is noted that, when the sheets S are loaded on the bottom plate 23, the connection portion 30*d* of the wire 30 sinks downward by weight of the sheets S, and an upper end portion of the connection portion 30*d* is in a state of being flush with an upper face of the bottom plate 23.

Meanwhile, when static electricity is generated by rubbing of the sheets S in feeding out the sheets S from the sheet feeding cassette 14, and the static electricity is accumulated in the sheet S in the sheet feeding cassette 14, a problem of multi-feed of the sheets S occurs in some cases. However, in the present embodiment, the static electricity accumulated in the sheet S in the sheet feeding cassette 14 is released from the sheets S through the wire 30, the lift plate 24, the rotating shaft 27, and the wire 31 to the body frame made of sheet metal of the device body 1A, and the problem of multi-feed of the sheets S due to static electricity is resolved by the grounding configuration as described above. That is, the static electricity can be released by the simple grounding configuration without adding new components for grounding, and the problem of multi-feed of the sheets S due to static electricity is resolved.

Further, in the image forming apparatus 1 shown in FIG. 1 including the sheet feeding cassette 14 according to the present disclosure, an effect obtained is such that cost reduction in the image forming apparatus 1 is promoted by cost reduction in the bottom plate 23 of the sheet feeding cassette 14, and a stable image forming operation can be realized by unfailingly feeding the sheets S one by one without causing the problem of multi-feed due to static electricity.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feeding cassette, comprising:

a bottom plate made of resin, with a sheet loaded thereon;

a lift plate having a tip end portion that abuttingly slides on a rear face of the bottom plate, and rotates for the tip end portion to displace the bottom plate to a sheet feeding position; and a wire rod that is bent to be wired on the rear face of the bottom plate and that comes into contact with the tip end portion of the lift plate, wherein the bottom plate includes an opening portion at which a portion of the bottom plate is opened, the wire rod includes: a pair of parallel portions that extend in a direction in which the tip end portion abuttingly slides; and a protruding portion connecting respective end portions of the parallel portions, the wire rod is wired on the rear face of the bottom plate such that the parallel portions are disposed in a sliding range of the tip end portion sliding on the rear face of the bottom plate, and such that at the protruding portion, a portion of the wire rod protrudes from the opening portion to a sheet loading face of the bottom plate, and the protruding portion contacts the sheet loaded on the bottom plate, and the wire rod is grounded so as to release static electricity accumulated in the sheet through the wire rod to a body frame.

2. The sheet feeding cassette according to claim 1, wherein, the lift plate includes a rotating shaft to rotate the lift plate, and the wire rod is conducted to the body frame through the lift plate and the rotating shaft of the lift plate.

3. The sheet feeding cassette according to claim 1, wherein, the protruding portion contacts the sheet by way of elasticity of the wire rod.

4. A sheet feeding device, comprising:

a sheet feeding cassette loaded thereon with a sheet, wherein the sheet feeding cassette comprises:

a bottom plate made of resin, with the sheet loaded thereon;

a lift plate having a tip end portion that abuttingly slides on a rear face of the bottom plate, and rotates for the tip end portion to displace the bottom plate to a sheet feeding position; and a wire rod that is bent to be wired on the rear face of the bottom plate and that comes into contact with the tip end portion of the lift plate, wherein the bottom plate includes an opening portion at which a portion of the bottom plate is opened, the wire rod includes: a pair of parallel portions that extend in a direction in which the tip end portion abuttingly slides; and a protruding portion connecting respective end portions of the parallel portions, the wire rod is wired on the rear face of the bottom plate such that the parallel portions are disposed in a sliding range of the tip end portion sliding on the rear face of the bottom plate, and such that at the protruding portion, a portion of the wire rod protrudes from the opening portion to a sheet loading face of the bottom plate, and the protruding portion contacts the sheet loaded on the bottom plate, and the wire rod is grounded so as to release static electricity accumulated in the sheet through the wire rod to a body frame.

5. The sheet feeding device according to claim 4, wherein, one end of the lift plate abuts on the wire rod so as to slide over a range sliding on the bottom plate.

6. The sheet feeding device according to claim 4, wherein, the lift plate includes a rotating shaft to rotate the lift plate, and the wire rod is conducted to the body frame through the lift plate and the rotating shaft of the lift plate.

7. The sheet feeding device according to claim 4, wherein, the protruding portion contacts the sheet by way of elasticity of the wire rod.

8. An image forming apparatus, comprising:

a sheet feeding device having a sheet feeding cassette on which a sheet is loaded; and an image forming portion that forms an image on the sheet fed from the sheet feeding device, wherein the sheet feeding cassette comprises:

a bottom plate made of resin, with the sheet loaded thereon;

a lift plate having a tip end portion that abuttingly slides on a rear face of the bottom plate, and rotates for the tip end portion to displace the bottom plate to a sheet feeding position; and a wire rod that is bent to be wired on the rear face of the bottom plate and that comes into contact with the tip end portion of the lift plate, wherein the bottom plate includes an opening portion at which a portion of the bottom plate is opened, the wire rod includes: a pair of parallel portions that extend in a direction in which the tip end portion abuttingly slides; and a protruding portion connecting respective end portions of the parallel portions, the wire rod is wired on the rear face of the bottom plate such that the parallel portions are disposed in a sliding range of the tip end portion sliding on the rear face of the bottom plate, and such that at the protruding portion, a portion of the wire rod protrudes from the opening portion to a sheet loading face of the bottom plate, and the protruding portion contacts the sheet loaded on the bottom plate, and the wire rod is grounded so as to release static electricity accumulated in the sheet through the wire rod to a body frame.

9. The image forming apparatus according to claim 8, wherein, one end of the lift plate abuts on the wire rod so as to slide over a range sliding on the bottom plate.

10. The image forming apparatus according to claim 8, wherein, the lift plate includes a rotating shaft to rotate the lift plate, and the wire rod is conducted to the body frame through the lift plate and the rotating shaft of the lift plate.

11. The image forming apparatus according to claim 8, wherein, the protruding portion contacts the sheet by way of elasticity of the wire rod.

* * * * *